United States Patent [19]

Pollack

[11] 4,257,333

[45] Mar. 24, 1981

[54] SHELVING STRUCTURE ADAPTED FOR QUICK ASSEMBLY AND ADJUSTMENT

[76] Inventor: Hyman Pollack, 41 Stonicker Dr., Lawrenceville, N.J. 08648

[21] Appl. No.: 6,968

[22] Filed: Jan. 26, 1979

[51] Int. Cl.[3] ..... A47B 9/08

[52] U.S. Cl. ..... 108/144; 108/111; 108/62

[58] Field of Search ..... 108/144, 111, 62; 248/407, 423

[56] References Cited

U.S. PATENT DOCUMENTS

| | | | |
|---|---|---|---|
| 2,437,940 | 3/1948 | Cramer et al. | 248/407 X |
| 2,677,470 | 5/1954 | Catalano | 108/62 |
| 3,280,767 | 10/1966 | Kahn | 108/144 |
| 3,424,111 | 1/1969 | Maslow | 108/144 |
| 3,472,476 | 10/1969 | Johnson | 108/144 X |
| 3,523,508 | 8/1970 | Maslow | 108/144 |
| 3,523,702 | 8/1970 | Unti et al. | 108/144 X |
| 3,675,598 | 7/1972 | Kesilman et al. | 108/144 |
| 3,757,705 | 9/1973 | Maslow | 108/144 |
| 3,874,511 | 4/1975 | Maslow | 108/144 |
| 4,132,178 | 1/1979 | Mueller et al. | 108/144 |

*Primary Examiner*—Francis K. Zugel

*Attorney, Agent, or Firm*—Frederick A. Zoda; John J. Kane; Albert Sperry

[57] ABSTRACT

A shelving unit including corner posts on which shelves are removably and adjustably mounted through the provision of sleeves provided at the corners of the individual shelves. In association with each sleeve, there is provided a saddle acting as a spacer between the sleeve and post. The saddle initially is interengaged with the posts through the provision of a lug and complementary recess on the saddle and post respectively. As one function of the saddle, there is defined a point of reference for aligning a threaded opening of the sleeve with the lug of the saddle, through the provision of a lip or abutment on the saddle engaged by the sleeve when it is lowered to its selected position along the length of the post. At this time, a threaded opening of the sleeve registers with an outwardly facing recess of the saddle defined by the formation of the saddle lug. A set screw engaged in the opening is now threadable into the outwardly facing recess of the saddle, locking the sleeve to the saddle and the saddle to the post in the selected position of vertical adjustment of the shelf. The post has a series of uniformly spaced recesses along its length, any of which can be selected to receive the saddle lug. The arrangement permits the sleeve to be formed with a substantially greater inner diameter than the outer diameter of the post, to facilitate the raising and lowering of the shelves. Additionally, the arrangement permits formation of a shelf which can be inverted, due to the provision of corner sleeves thereon that are of constant inner and outer cross-sectional shape and size over their entire lengths, and that have set screws located midway between their lengths, thus to permit a shelf to incorporate a peripheral, protective side rail should the user so desire.

9 Claims, 8 Drawing Figures

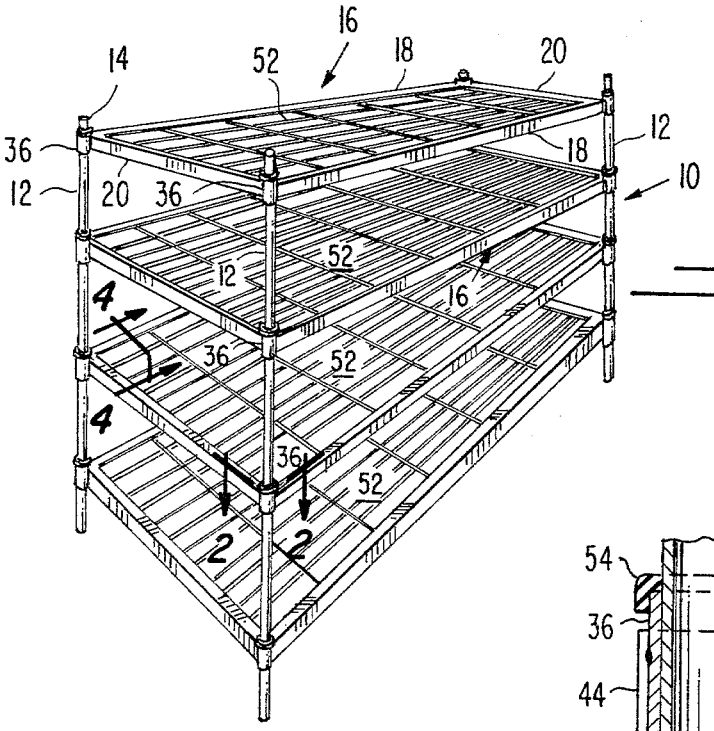
Fig. 1.
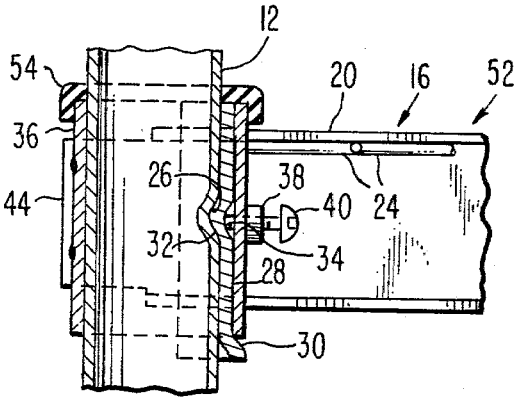
Fig. 3.
Fig. 2.
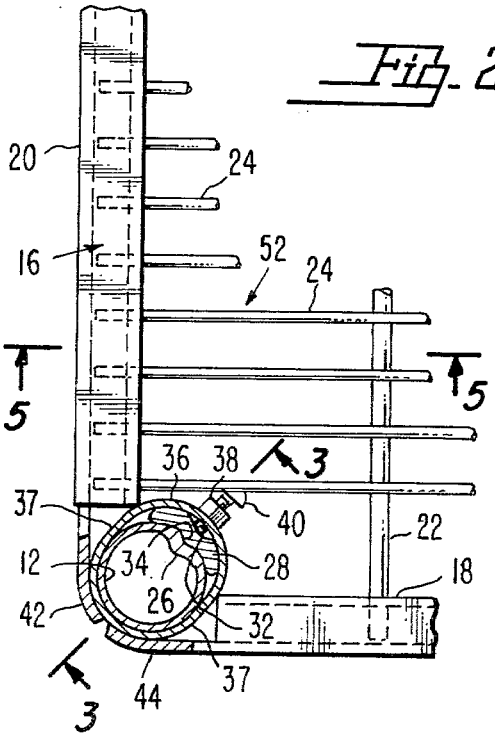
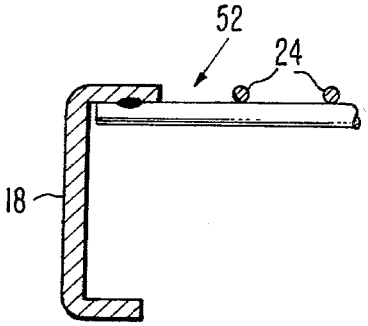
Fig. 4.

SHELVING STRUCTURE ADAPTED FOR QUICK ASSEMBLY AND ADJUSTMENT

BACKGROUND OF THE INVENTION

The present invention relates generally to a shelving unit of the so-called "knock-down" type, designed to be shipped in a relatively compact form, and swiftly assembled at the point of use with any number of shelves, adjusted vertically along associated corner posts to selected, adjusted heights.

DESCRIPTION OF THE PRIOR ART

In the field to which the invention relates, shelving units designed for quick assembly and for vertical adjustment of the shelves are, in and of themselves, well known. Units of this type are particularly designed for on-site assembly, in lengths, areas, widths, heights, and modular arrangements selected by the customers. Such use areas may be, for example, storage areas in warehouses; the storerooms of hospitals, restaurants, supermarkets, and the like; or in any of a wide variety of other locations where it is necessary to provide maximum storage areas for articles capable of being shelf-supported. Typically, shelving structures of this type incorporate open wire shelving, for purposes of sanitation, air circulation, and visibility (to state some of the reasons for such open wire shelving); and, it is often also true that shelving units of this type may be designed not only for stationary installation, but also, may be in the form of rollable carts, dolly frames, or hand trucks.

In the prior art, it is common to provide separate elements of shelving structures of the character described, as for example pre-constructed shelves, posts, protective back and side ledges, and the like. These are brought together according to the needs of a particular customer, which as noted above may be and often is an institutional or manufacturing organization, so that the customer may have either a stationary or if desired a rollable shelving structure designed to its particular and exact requirements.

In the prior art, it has become necessary to develop means for first assembling shelves with the vertical posts or support members associated therewith, and thereafter incorporate lock means for locking the shelves to the vertical support members in selected positions to which the shelves have been adjusted after initial assembly with the posts. In these circumstances, it has become necessary to design sleeve-like corner portions on the shelves, adapted to slide upwardly and downwardly upon the corner posts to the selected position of vertical adjustment. The sleeve-like means on the shelves has typically, in many instances, required tapered shelf supports, as for example in the arrangement shown in U.S. Pat. No. 3,424,111 issued to L. Maslow on Jan. 28, 1969. A similar arrangement is shown in Maslow U.S. Pat. No. 3,523,508, it being understood that these patents are offered merely as being representative of conventional taper lock devices in shelving structures of the character described.

In other arrangements, it has been proposed to utilize posts having a sectional instruction, wherein the sections of the posts are assembled by means of bayonet slots and lugs, as exemplified in Davis U.S. Pat. No. 3,851,601. Typical too is Kesilman et al U.S. Pat. No. 3,675,598 issued July 11, 1972 and Johnson U.S. Pat. No. 3,472,476 issued Oct. 14, 1969. In the Johnson patent, a sleeve is vertically adjustable along the length of the corner post, and has a rockable spacer element.

All of the prior art structures noted above have certain disadvantages along with the obvious advantages of quick assembly and adaptability for construction with standard parts to particular requirements of a customer. For example, in the Johnson patent an accidental upward jarring movement imparted to a shelf may tend to disengage the corner locking means, with possibly unfortunate results involving tilting of the shelf, or its being bodily dropped onto the next lower shelf. And, in those arrangements involving tapered corner locks, the inversion of a shelf according to the desires of a user, to provide a shelf with or without a peripheral protective ledge, is not possible. In still other instances, constructions such as have been described in the prior art tend to be expensive, or may undesirably slow assembly or disassembly, or may tend to produce crevices in which food or dirt may lodge. Any or all of these characteristics are obviously undesirable, particularly when a shelving unit is to be used in the support of food items, or in areas in which an exceptionally high degree of sanitation is to be maintained—in hospitals, convalescent homes, and restaurants, for example.

SUMMARY OF THE INVENTION

The invention, summarized briefly, comprises a shelving structure of the quickly assembled and adjustable type, which can incorporate standard shelf units and corner posts. A customer, thus, may specify a particular shelf structure of selected length and depth, having a requisite number of shelves, intended to be spaced a distance apart according to the special needs of the purchaser. The invention in this respect meets the same requirements as the above-mentioned prior art devices, it being understood that these requirements must be met by all shelving structures of the category described.

In accordance with the invention, there is provided, upon each shelf, a plurality of corner sleeves, each of which is of constant cross-sectional shape, both interiorly and exteriorly, over its full length, so that each sleeve (and hence each complete shelf) can be inverted end for end. The shelf support frame includes side and end rails, which are preferably of channeled construction, and which support, in a preferred example, crossed wires or rods, which are attached to one flange of the channeled rails. In this way, positioning of the shelf with the wire-attached flange up produces a shelf that has no peripheral protective ledges. Such shelves are needed by many users, as for example when the shelf is to support large cartons that must be slid onto or off the shelf.

In another arrangement, the shelf is inverted with the free flanges of the rails up, so that the rails extend above the plane of the article-supporting wires or rods. In this arrangement, the shelves now define a peripheral protective ledge or fence, adapted to prevent articles from accidentally sliding off the shelf. This arrangement is desirable when the shelf is being used to support small articles, for example, such as cans, bottles, etc. In either case, the shelf can be inverted side for side, and no matter which side is up, the corner sleeves remain identically disposed with respect to the cooperating locking means provided upon the post.

The locking means comprises an important features of the invention, and in accordance with the invention each post is provided with a plurality of regularly spaced indentations or recesses. An arcuate saddle is associated with each corner sleeve of a shelf, and at one end has an outwardly projecting lip or abutment. Each saddle is also formed with an inwardly projected lug, engageable in a selected recess of the post. Formation of the lug in each saddle defines an outwardly facing recess on the convex, outer surface of the saddle. This recess is adapted to receive a screw threadably engaged in the shelf support sleeve, when the sleeve is lowered into engagement with the lip of the saddle while the saddle lug is interengaged with the selected recess of the corner post. In these circumstances, the screw registers with the outwardly facing locking recess of the saddle, and when threaded inwardly interlocks the post, saddle, and sleeve securely in the selected position of vertical adjustment.

Means is provided to temporarily support the saddle during assembly of a shelf with its associated corner posts. This means, in a preferred embodiment, comprises an approximately semi-circular clip, detachably, springably engaged with the corner post in such fashion as to cause the saddle to be properly positioned at the selected level where it will interengage with the post, by abutting of the saddle against the clip. When the shelf has been lockably assembled with the corner posts, the clips can be swiftly and easily detached from the post for re-use in assembling other shelves with the posts.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a perspective view of a typical shelving structure assembled with units fabricated according to the present invention;

FIG. 2 is an enlarged, fragmentary, horizontal sectional view through one of the corner areas of the shelving structure of FIG. 1, taken substantially on line 2—2 of FIG. 1;

FIG. 3 is a fragmentary, vertical sectional view through the corner assembly shown in FIG. 2, on the same scale as FIG. 2, taken substantially on line 3—3 of FIG. 2;

FIG. 4 is a fragmentary, detailed sectional view through one of the side rails of a shelf constructed according to the present invention, taken on line 4—4 of FIG. 1, on the same scale as FIG. 3;

DETAILED DESCRIPTION OF THE PREFERRED EMBODIMENT

In FIG. 1 I have illustrated by way of example a typical shelving structure assembled according to the present invention. It will be understood, in this connection, that this is merely one type of shelf assembly that can be erected, and that as will presently appear, the invention permits a wide variety of shelving structures or systems, according to the needs or desires of the particular institution, mercantile establishment, or manufacturing company using the shelving. Additionally, the shelving structure can be rollably supported and can incorporate handles, bins, or the like, again according to the requirements of the customer. In any event, in the typical arrangement illustrated, the shelving unit generally designated 10 includes a rectangular series of uprights or corner posts 12. In the illustrated embodiment, these are formed as tubular members of circular cross section, although this is not critical to successful practicing of the invention. Said members can be made in the form of a single tubular member, or alternatively, can be provided with extension members, not shown. The invention, of course, lends itself to assembly of the shelves with one-piece lengths of tubing defining the corner posts 12.

Figure 7:
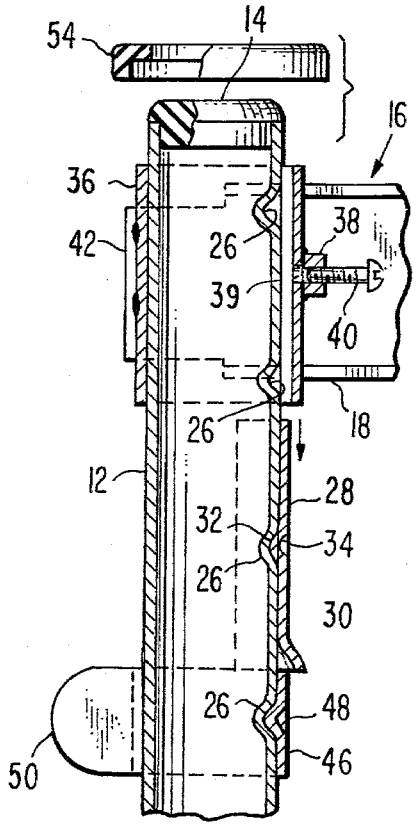
FIG. 7 is a vertical sectional view, similar to FIG. 3, illustrating the parts as they approach their finally assembled relationship, as compared to FIG. 3 which shows the parts in their final, locked position.

The corner posts, as shown in FIG. 7 can be suitably capped as at 14 with rubber or plastic end closures, and additionally, at their lower ends could if desired be provided with either casters, wheels, or adjustable feet. None of these is shown, since such expedients are of course well known in the art.

Generally designated 16 is a series of identically formed, pre-assembled shelves. In the illustrated example, each shelf is of elongated, rectangular, flat configuration, and is of the open wire type, including channeled, inwardly facing side rails 18, and channeled, also inwardly facing, end rails 20. The channels defining the respective rails 18, 20, are assembled with a plurality of relatively rigid, large diameter wire cross members 22, which are uniformly spaced along the length of the shelf, and which extend transversely thereof from one to the other side rail. The cross members 22, at their ends, are welded to one of the inwardly facing flanges of the channeled side rails 18. As a result, the horizontal plane of the several wire cross members 22 may be considered as being in the general plane of the channel flanges to which they are welded.

Figure 5:
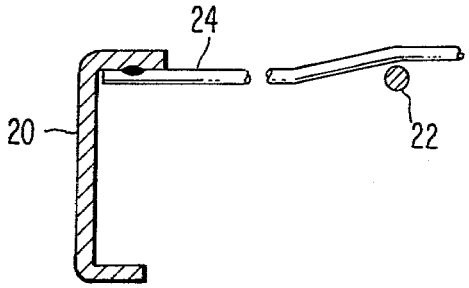
FIG. 5 is a view similar to FIG. 4, through one of the end rail portions of a shelf, taken substantially on line 5—5 of FIG. 2.

Also illustrated, by way of example, are longitudinal wire members 24. In the illustrated example these are spaced more closely than are the cross members, and these are welded or otherwise fixedly secured to the flanges of the end rails that correspond to the flanges of the side rails to which the cross members 22 are permanently attached. Although both the longitudinal and transverse wire members are relatively strong and rigid, they do flex sufficiently to permit the longitudinal and transverse wire members to cross as shown, for example, in FIG. 5.

It is understood that it is not essential to the successful practicing of the present invention that the wire cross members be arranged exactly as illustrated above, that is, the longitudinal and transverse members could be of the same diameter, and the spacing thereof could be varied as desired, according to the nature of the particular articles to be supported, and the strength which is to be incorporated in each shelf. It is possible, further, that the shelf panel defined by the crossed members 22, 24 could be a flat piece of metal or the like, which can be supported upon the cross members and the longitudinal members, or alternatively, can be made sufficiently rigid in some other way, as for example, by pressing strengthening ribs into the metal material of which the panel is formed.

The main improvement to which the present invention is directed resides in the means for assembling the shelves 16 with the corner posts, and locking the shelves to the corner posts. In accordance with the present invention, there is provided a plurality of elongated, shallowly transversely curved saddles 28, the cross-sectional shape and thickness of which remains constant from end to end thereof. Each saddle 28, at its lower end, is formed integrally with an outwardly projecting lip or abutment 30. Substantially midway between the opposite ends of each saddle, there is formed an inwardly directed locking lug 32. This is formed directly out of the material of the saddle itself, as shown to best advantage in FIGS. 2 and 3. Locking lug 32 projects inwardly from the concave inner face or surface of the saddle. Formation of the locking lug defines, in the outer surface or face of the saddle, a locking recess 34, registered with the inwardly projecting lug or boss 32.

At each corner of the shelf 16, there is provided a sleeve 36, the interior and exterior cross-sectional shape and dimensions of which are constant from end to end. This is for the purpose of permitting inversion of the sleeve end for end, according to whether the shelf is to be mounted with the wire cross members at the bottom as in FIG. 8, or with said wire cross members at the top as in the other figures of the drawing.

In any event, sleeve 36, as shown to best advantage in FIG. 2, is not of circular internal and external cross section, but rather, has somewhat flattened sides as shown at 37, so that the sleeve is given an oblong internal and external cross-sectional configuration. The sleeves thus fit very loosely upon the corner posts 12 which are of circular cross section, and this is highly desirable, since it permits each shelf to be swiftly adjusted vertically upwardly or downwardly upon the corner posts, due to the relatively loose fit of the sleeves upon the posts during assembly or adjustment of the shelves upon the posts. Were the sleeves to have a circular internal cross section, substantially duplicating the external cross section of the posts, the shelves would not be movable vertically upon the posts with ease during assembly or adjustment, since they would tend to bind upon the posts during such movement, unless great care were maintained to maintain the shelves in exactly horizontal planes. The loose fit of the sleeves upon the corner posts, during assembly or adjustment, eliminates this undesirable characteristic.

Figure 6:
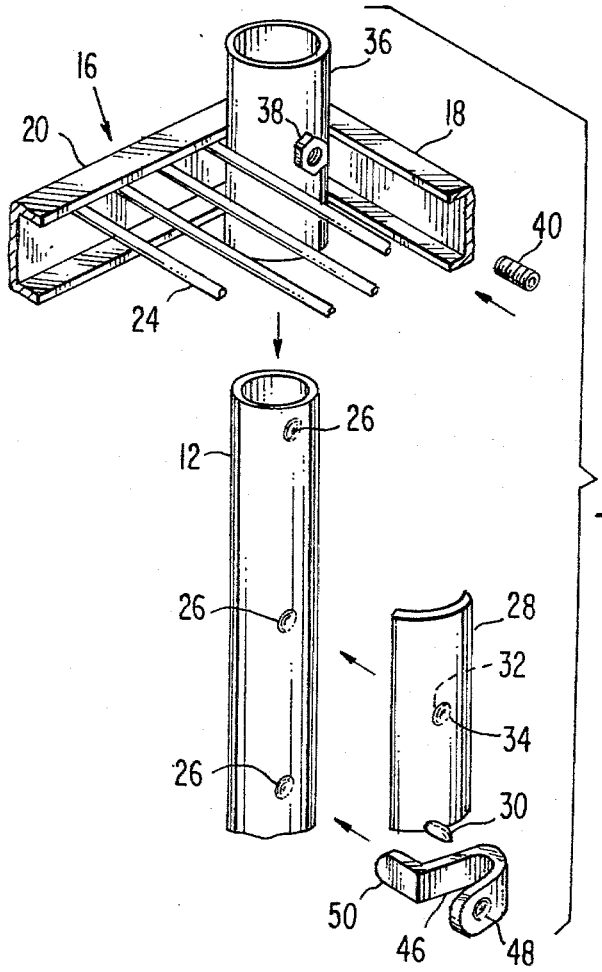
FIG. 6 is a fragmentary, exploded perspective view illustrating the manner of assembly of a shelf with a corner post.

Referring to FIGS. 6 and 7, it will further be observed that each sleeve 35 is formed, midway between its opposite ends, with means to receive a locking or set screw. In the illustrated example, such means comprises a nut 38, registering with a smooth-walled opening 39 formed in the wall of the sleeve, the nut being welded to the outer surface of the sleeve so as to permit the associated screw 40 to be threadable inwardly through opening 39 to the locking position of the screw.

The several sleeves 36 are assembled with the side and end rails, in the illustrated, preferred embodiment, through the provision of extension tongues 42, 44 formed upon the rails 20, 18 respectively. Tongues 42, 44 extend beyond the ends of the flanges of the channeled rails, and are curved at their outer ends, so as to be disposed in fact-to-face contact with the associated sleeves 36, to which the tongues 42, 44 are then welded or otherwise permanently secured.

In use of the invention, I prefer to provide temporary saddle positioning means in the form of approximately semi-circular spring clips 46, shown in FIGS. 6 and 7. Each of these includes, at one end, an inwardly pressed indentation or locking lug 48, adapted to interengage with any selected indentation 26 formed along the length of the associated corner post (see FIG. 6). The clip, when applied to the corner post, is held temporarily thereagainst by means of the mentioned interengagement of the lug 48 in the selected recess 26, and defines an abutment for the lower end of the saddle 28. The saddle 28 is positioned upon the clip, with its lug 32 engaged in the recess 26 next above that which engages lug 48 of the positioning clip. With the saddle in position as shown in FIG. 7, the shelf is lowered, again as shown in FIG. 7, with the corner sleeves 36 moving freely downwardly along the length of the post, until the sleeve receives the full length of the associated saddle 28 and engages against the lip 30 of the saddle in the position shown in FIG. 3. At this time, the set screw 40 will be in registration with the outwardly facing locking recess 34 of the saddle, and one need only turn the set screw 40 home, to the position shown in FIGS. 2 and 3. This locks the shelf at each corner, in the selected position of vertical adjustment. One now grasps handle 50 formed upon the other end of the clip 46, and removes the clip from the post, it being understood that the clip will have initially grasped the post only very lightly.

Obviously, the clip can also be used to engage around the upright with the saddle interposed therebetween, with the lug 48 now engaging in recess 34.

The construction, as shown in FIG. 2, causes the saddle 28 to be interposed as a spacer between the sleeve and the associated corner post, with the inwardly facing lug 32 of the saddle engaging in the outwardly facing recess 26 of the post, and with the set screw 40 engaging in the outwardly facing recess 34 of the saddle. All of these interlocked recesses and lugs, and the set screw, are in registration with each other, so that none of the parts is relatively movable following the final positioning and locking of the sleeve.

A very strong, and secure locking arrangement is thus provided, accompanied by a capacity for swift and easy assembly or disassembly. In the arrangement illustrated, once the set screw is turned home, none of the parts can move relative to any of the other parts, and it is impossible to destroy the locking action even if the shelf is subjected to accidental jarring or heavy impact. In every instance, the shelf remains securely locked, even when supporting great weight.

Yet, the invention is so designed as to permit each shelf to be detached from the posts with equal ease and facility. This is done by backing off the set screw, to the FIG. 7 position, after which the shelf is simply lifted upwardly to clear to saddle. The saddle now is free to drop off the corner posts and be positioned at another, selected elevation should this be desired. Or, the shelving can be completely disassembled, and the parts can be readily stored for re-use when the shelf structure is to be assembled once again.

Figure 8:
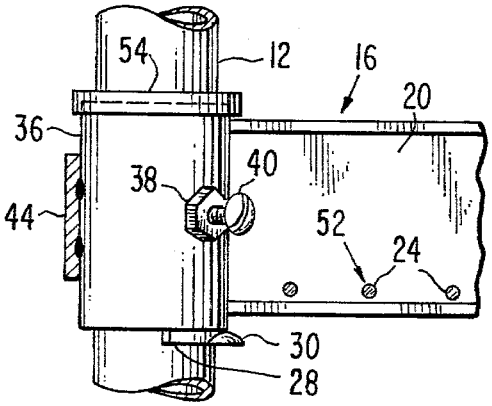
FIG. 8 is a fragmentary, vertical sectional view illustrating the shelf inverted to provide protective end and side ledges.

The arrangement is also highly desirable, in that it permits inversion of any shelf, to the FIG. 8 position. When this is done, the sleeve 36 is positioned exactly as in FIGS. 2 and 3, since the set screw is midway between the opposite ends of the sleeve, and the channeled framing structure is located, also, medially between the opposite ends of the sleeve (see FIG. 3).

A customer may, of course, desire to invert the shelf from the FIG. 6 or FIG. 4 position, when it is necessary to provide a protective, peripheral rail or ledge to prevent articles from accidentally sliding off the shelf. This is important where the articles are small and, perhaps, formed with slippery surfaces. In other instances, of course, the shelf may be positioned with the crossed wire members up, as in FIG. 5, and this eliminates a protective side rail. The FIG. 5 arrangement may be desirable when, for example, the shelving is to support large objects such as cartons, in a manner intended to permit the objects to be slid onto or off of the shelf element or mat with maximum speed and ease.

In either instance, the locking assembly is identical, that is, the actual locking assembly defined by the recessed post, saddle, and sleeve appears as in FIG. 3 no matter which face of the shelf is turned upwardly.

The construction has the further desirable advantage of eliminating not only an expensive, complicated assembly arrangement, but also, providing a simplified structure reducing to a minimum the number of crevices in which food or dirt may lodge. The arrangement, indeed, facilitates flushing of the corner locking assembly, this being of importance in installations in which the shelving has to be washed down periodically to maintain a proper level of sanitation.

It is important that when the shelving unit illustrated and described herein is to be used under conditions in which food particles or the like may tend to lodge in crevices of the shelf mounting and locking means, as for example, in the space between sleeve 36 and post 26 at opposite sides of saddle 28, every care should be taken to prevent such an occurrence. While the invention lends itself to ready flushing of said particles from the locations noted, it is still desirable to minimize the possibility of lodging of the particles in the corner structure of each shelf. To this end, I may use a flexible rubber or plastic cap 54 (see FIGS. 3 and 6) apertured to receive the post and be slidably adjusted downwardly thereon to the position shown in FIG. 3, in which it wholly closes the corner structure at its upper end against the admission of said particles.

It is understood, of course, that the construction illustrated and described is merely exemplary of the presently preferred, best mode of practicing the invention. It is within the spirit of the invention, of course, that the sleeves be used elsewhere than at the corners of the shelves, as for example, there could be provided, upon an elongated shelf, locking sleeves at the four corners thereof along with intermediate locking sleeves located between the opposite ends of the shelf.

It is, of course, also true that thumb screws might be used instead of the set screw illustrated, to eliminate the need of any tools during assembly or disassembly of the shelf unit.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A shelf unit comprising:

(a) at least one upright;

(b) spacer means engageable with said upright, said spacer means and upright including mating means for locating the spacer means upon the upright and for engaging the spacer means against movement along the length of the upright;

(c) a sleeve receiving and freely slidable along the length of the upright, said sleeve being locatable with the spacer means interposed between the sleeve and upright, said sleeve including means for interengaging the sleeve with the spacer means when the sleeve is so located, to interlock the sleeve, upright, and spacer against relative movement; and (d) a shelving element secured to the sleeve, the spacer means including an abutment engageable with the sleeve to position the sleeve for interengagement with the spacer means, the spacer means being in the form of a saddle disposed in face-to-face contact with the upright upon interengagement of said mating means of the upright and spacer means, said mating means comprising an inwardly facing lug on the saddle and a recess in the upright receiving the lug, the formation of said lug defining an outwardly facing recess on the saddle engageable by said means of the sleeve for interlocking engagement of the upright, saddle, and sleeve.

2. A shelf unit as in claim 1 wherein the means on the sleeve for interengaging the same with the saddle comprises a threaded element shiftable radially inwardly of the sleeve into the outwardly facing recess of the saddle.

3. A shelf unit as in claim 2 wherein the upright is of circular outer configuration, said saddle being transversely curved for engagement with the post in face-to-face contact therewith, said sleeve having a generally oblong internal cross section for receiving the saddle and the post in the interlockingly engaged positions of the post, saddle, and sleeve.

4. A shelf unit as in claim 3 wherein the threaded member of the sleeve is disposed medially between the opposite ends of the sleeve, the lug and recess of the saddle being disposed substantially medially between the opposite ends of the saddle, for reversal of the sleeve end for end upon the saddle whereby to permit inversion of the shelf upon assembly of the shelf with the upright.

5. A shelf unit as in claim 4 wherein the shelf includes a peripheral series of framing rails and a mat carried by and bounded by said rails for supporting objects, said mat being substantially planiform and said rails extending substantially entirely at one side of the plane of the mat, whereby to permit inversion of the shelf side for side responsive to said sleeve reversal, thus to dispose said rails, at the option of a user, as protective ledges for confining the supported objects against accidental slippage from the surface of the shelf.

6. A shelf unit as in claim 5 wherein said rails are of channeled formation to define, on each rail, edge flanges to one of which said mat is secured.

7. A shelf unit as in claim 4 wherein the recess of the upright, the lug and recess of the saddle, and the threaded member of the sleeve are all in registration upon engagement of the sleeve against the abutment of the saddle whereby extension of the threaded member into the recess of the saddle will interlock the saddle with the upright and the sleeve with the saddle.

8. A shelf unit as in claim 7 further including a removable clip having a lug engageable with a selected recess, said clip engaging the saddle with the mating means of the saddle and upright interengaged with each other, for temporary location of the saddle preliminary to extension of the sleeve into engagement with the abutment of the saddle and extension of the threaded member of the sleeve into the recess of the saddle.

9. A shelf unit comprising:

(a) a series of spaced, generally vertically disposed corner posts each of which has a plurality of uniformly spaced recesses formed therein and spaced along the length of each post;

(b) a plurality of shelf assemblies each of which extends between and is supported upon the several corner posts, said shelf assemblies being spaced vertically of the posts at selected locations along the length of the posts, each shelf assembly including (1) an article-supporting mat, (2) a plurality of locking sleeves receiving the several corner posts and slidable to selected positions along the length of said posts, and (3) threaded elements carried by the several sleeves and extendable radially inwardly of the sleeves; and (c) a saddle interposed between each sleeve and the post received in the sleeve, each of said saddle being in the form of an elongated, transversely curved plate disposed in face-to-face contact with the outer surface of the corner post and the inner surface of the associated sleeve, each saddle including, substantially midway between its ends, an integral, inwardly directed lug defining a projection on the concave surface of the saddle and the formation of said lug defining a recess on the convex surface thereof, the projection of each saddle being engageable in a selected recess of the associated corner post, each saddle including at one end an abutment engageable by the sleeve, said sleeve when engaged against the abutment of the saddle being disposed with its threaded member in registration with the projection of the saddle and the post recess in which said projection is engaged, said threaded member being further aligned with the outwardly facing recess of the saddle, for threading of said member into the outwardly facing saddle recess when the sleeve is engaged against the saddle abutment, whereby to interlock the sleeve, saddle, and corner post.

* * * * *